US012150570B1

(12) United States Patent
Purcell et al.

(10) Patent No.: US 12,150,570 B1
(45) Date of Patent: Nov. 26, 2024

(54) PICTURE-HANGING METHOD

(71) Applicants: Augustus M. Purcell, Laurinburg, NC (US); Charles Augustus Purcell, II, Laurinburg, SC (US); Jackson McKeithan Purcell, Laurinburg, SC (US)

(72) Inventors: Augustus M. Purcell, Laurinburg, NC (US); Charles Augustus Purcell, II, Laurinburg, SC (US); Jackson McKeithan Purcell, Laurinburg, SC (US)

( * ) Notice: Subject to any disclaimer, the term of this patent is extended or adjusted under 35 U.S.C. 154(b) by 76 days.

(21) Appl. No.: 18/144,926

(22) Filed: May 9, 2023

(51) Int. Cl.
*A47G 1/20* (2006.01)

(52) U.S. Cl.
CPC ..... *A47G 1/205* (2013.01)

(58) Field of Classification Search
CPC . A47G 1/16; A47G 1/20; A47G 1/205; A47G 1/162
USPC ..... 248/489, 497, 466
See application file for complete search history.

(56) References Cited

U.S. PATENT DOCUMENTS 3,074,680 A * 1/1963 Stewart ..... A47G 1/1613 248/224.7
3,367,617 A * 2/1968 Ellis ..... A47G 1/1606 248/300
4,455,756 A * 6/1984 Greene ..... A47G 1/205 33/613
4,893,776 A * 1/1990 Floyd ..... B25H 7/00 33/666
5,236,168 A 8/1993 Roy
5,267,719 A * 12/1993 Keller ..... A47G 1/20 248/475.1
6,032,915 A * 3/2000 Brindisi ..... A47G 1/1613 248/496
6,185,831 B1 2/2001 Pluciennik
6,830,228 B2 12/2004 Ernst
6,971,184 B2 12/2005 Prevost
7,155,840 B1 1/2007 Carbonaro
7,293,754 B2 * 11/2007 Gallien ..... A47G 1/1606 248/221.11
7,797,853 B2 * 9/2010 Compton ..... A47G 1/205 33/666
8,113,476 B2 * 2/2012 Serio ..... A47G 1/20 248/306
8,272,619 B2 * 9/2012 Ernst ..... A47G 1/20 248/475.1

(Continued)

FOREIGN PATENT DOCUMENTS

DE 202011109365 U1 * 3/2012 ..... A47G 1/202
WO 2017035647 3/2017

*Primary Examiner* — Eret C McNichols
(74) *Attorney, Agent, or Firm* — Kyle A. Fletcher, Esq.

(57) ABSTRACT

The present invention presents a picture hanging device and a method of hanging a picture utilizing the picture hanging device. A picture may be hung on a display wall using the picture hanging device to position and hold the picture. The picture may be hung at a specific location on the display wall by placing the picture onto the picture hanging device, moving the picture to the specific location using the picture hanging device, pressing on the picture hanging device to impale a hanger of the picture hanging device into the display wall, and removing the picture hanging device—leaving the picture hanging on the hanger at the specific location.

20 Claims, 9 Drawing Sheets

(56) References Cited

U.S. PATENT DOCUMENTS

| | | | | |
|---|---|---|---|---|
| 8,308,122 | B1 * | 11/2012 | Wadia | A47G 1/20 248/475.1 |
| 9,032,637 | B2 | 5/2015 | Propp | |
| 9,351,594 | B2 * | 5/2016 | Mehra | G01B 3/002 |
| 9,826,845 | B2 | 11/2017 | Krake et al. | |
| 9,872,574 | B2 * | 1/2018 | Royak | F16M 13/02 |
| 10,047,903 | B2 | 8/2018 | Bruno | |
| 10,441,098 | B2 * | 10/2019 | Bruno | B25C 3/008 |
| D938,244 | S | 12/2021 | Zhan | |
| 11,304,547 | B2 | 4/2022 | Hammond | |
| 11,324,342 | B2 * | 5/2022 | Asbury | A47G 1/20 |
| 2006/0038105 | A1 * | 2/2006 | Gallien | A47G 1/1606 248/497 |
| 2006/0196069 | A1 | 9/2006 | Groepper | |
| 2006/0231721 | A1 * | 10/2006 | Robic | A47G 1/205 248/497 |
| 2009/0101778 | A1 * | 4/2009 | Klein | A47G 1/205 248/220.22 |
| 2009/0283650 | A1 * | 11/2009 | Yates | A47G 1/205 248/220.21 |
| 2009/0313843 | A1 | 12/2009 | Compton | |
| 2010/0219323 | A1 * | 9/2010 | Ernst | A47G 1/20 248/475.1 |

* cited by examiner

PICTURE-HANGING METHOD

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of picture hanging systems and methods of hanging pictures, more specifically, a method of hanging a picture.

SUMMARY OF INVENTION

The present invention presents a picture hanging device and a method of hanging a picture utilizing the picture hanging device. A picture may be hung on a display wall using the picture hanging device to position and hold the picture. The picture may be hung at a specific location on the display wall by placing the picture onto the picture hanging device, moving the picture to the specific location using the picture hanging device, pressing on the picture hanging device to impale a hanger of the picture hanging device into the display wall, and removing the picture hanging device-leaving the picture hanging on the hanger at the specific location.

An object of the invention is to select a position for a picture on a display wall using a picture hanging device and to hang the picture at the specific location selected using the picture hanging device.

Another object of the invention is to provide a holder platform and C channel for holding a picture at a specific location on a display wall.

A further object of the invention is to provide a press bar for retaining a hanger behind the picture.

Yet another object of the invention is to provide a method for hanging a picture such that the user may visually align the picture on the display wall while the picture is supported by the picture hanging device and may hang the picture by pressing the upper portion of the picture hanging device and by removing the press bar and C channel from behind the picture.

These together with additional objects, features and advantages of the method of hanging a picture will be readily apparent to those of ordinary skill in the art upon reading the following detailed description of the presently preferred, but nonetheless illustrative, embodiments when taken in conjunction with the accompanying drawings.

In this respect, before explaining the current embodiments of the method of hanging a picture in detail, it is to be understood that the method of hanging a picture is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the method of hanging a picture.

It is therefore important that the claims be regarded as including such equivalent construction insofar as they do not depart from the spirit and scope of the method of hanging a picture. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
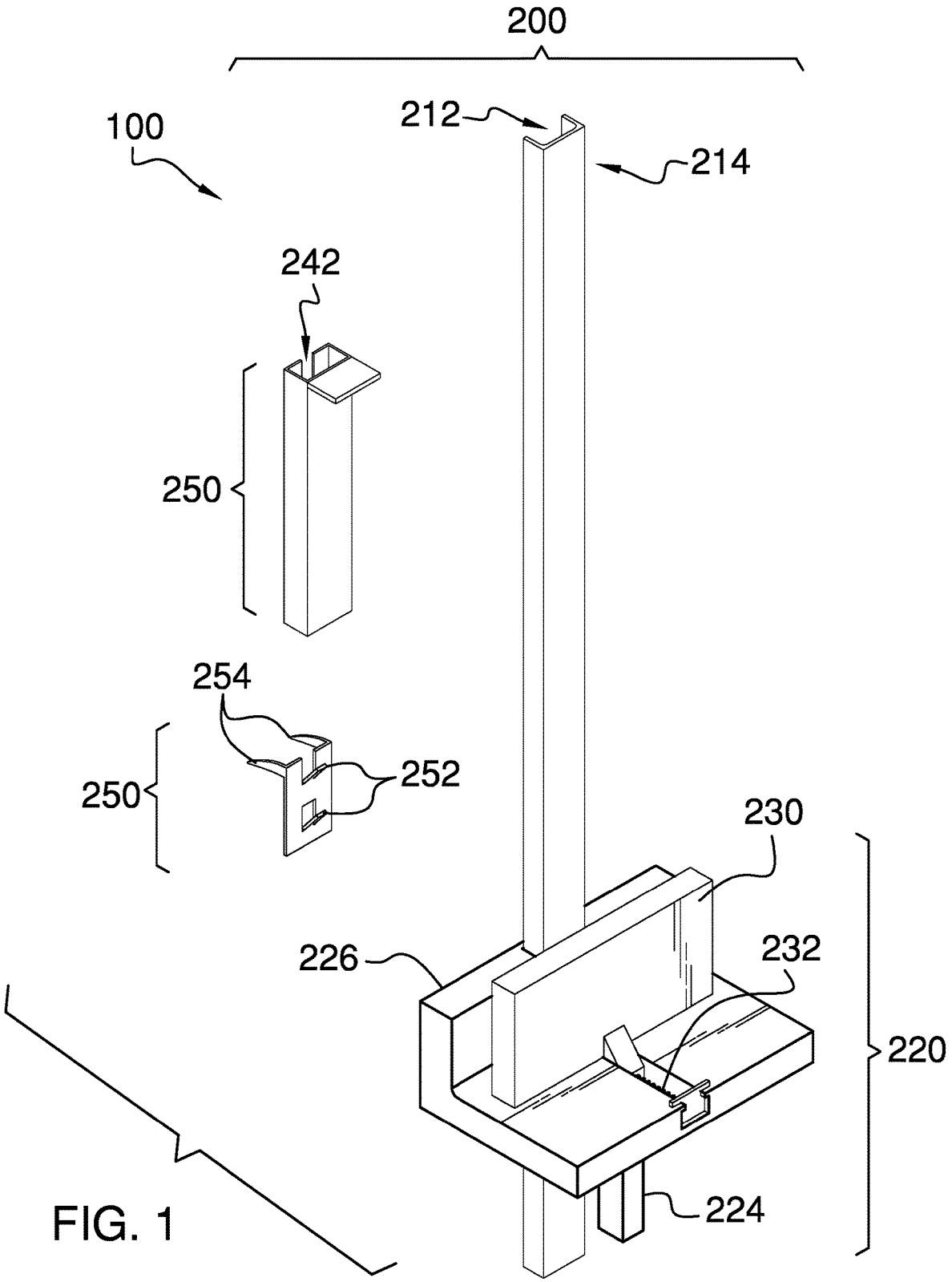
FIG. 1 is an isometric view of an embodiment of the disclosure, illustrating the picture hanging device.
Figure 2:
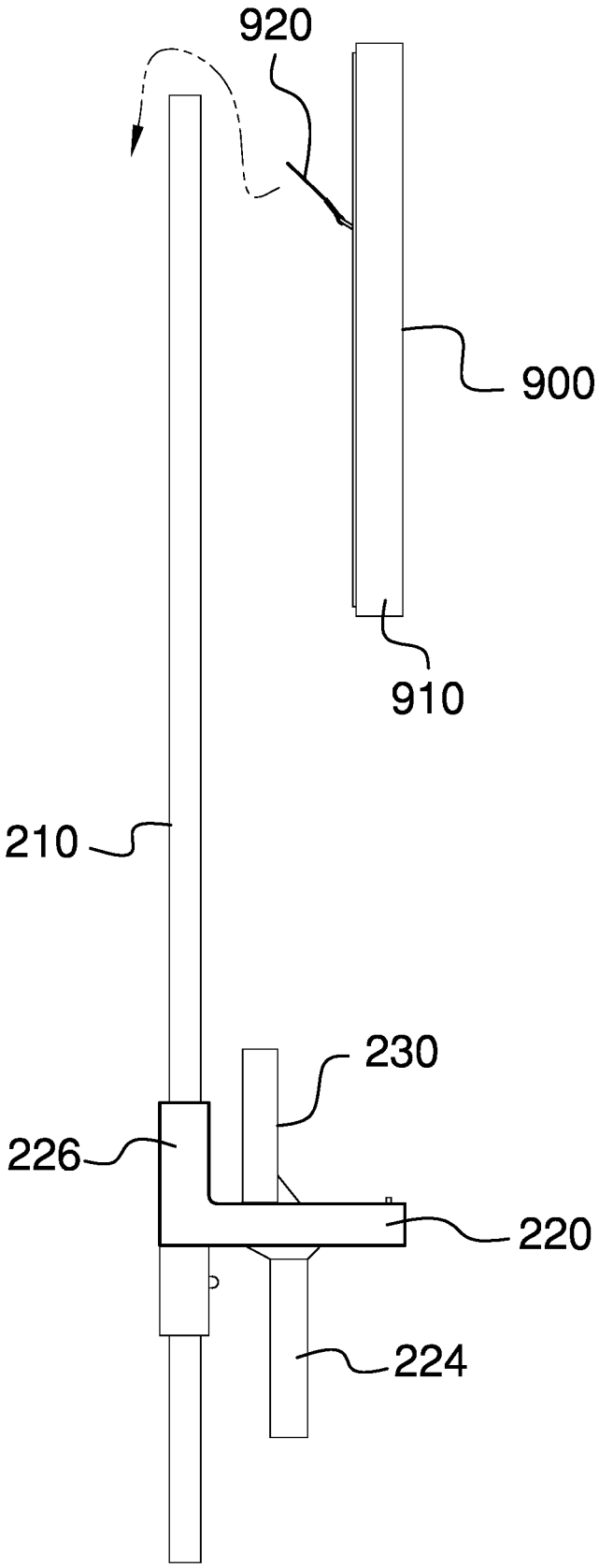
FIG. 2 is a left side view of an embodiment of the disclosure, illustrating the step of sliding the picture cord over the top of the C channel.
Figure 3:
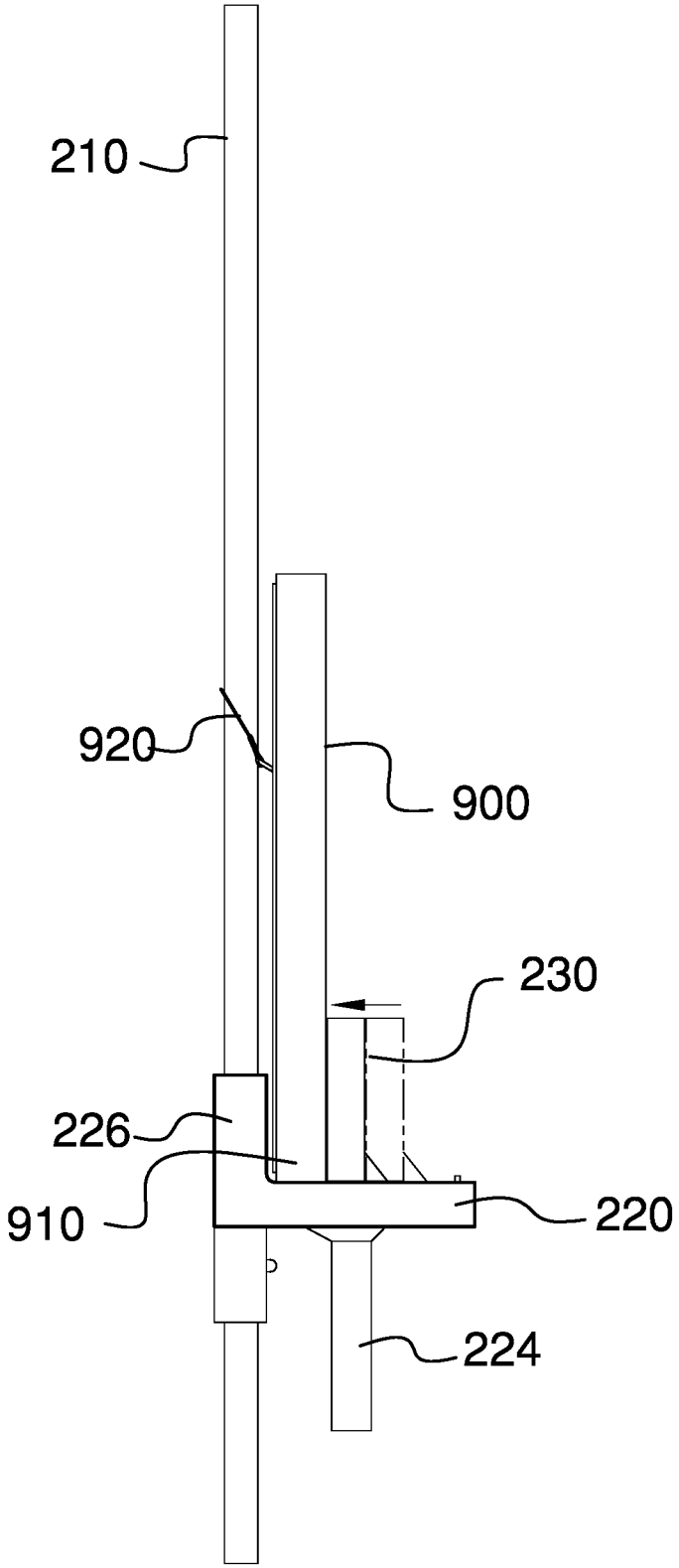
FIG. 3 is a left side view of an embodiment of the disclosure, illustrating the step of placing the bottom of the frame of the picture onto the holder platform.
Figure 4:
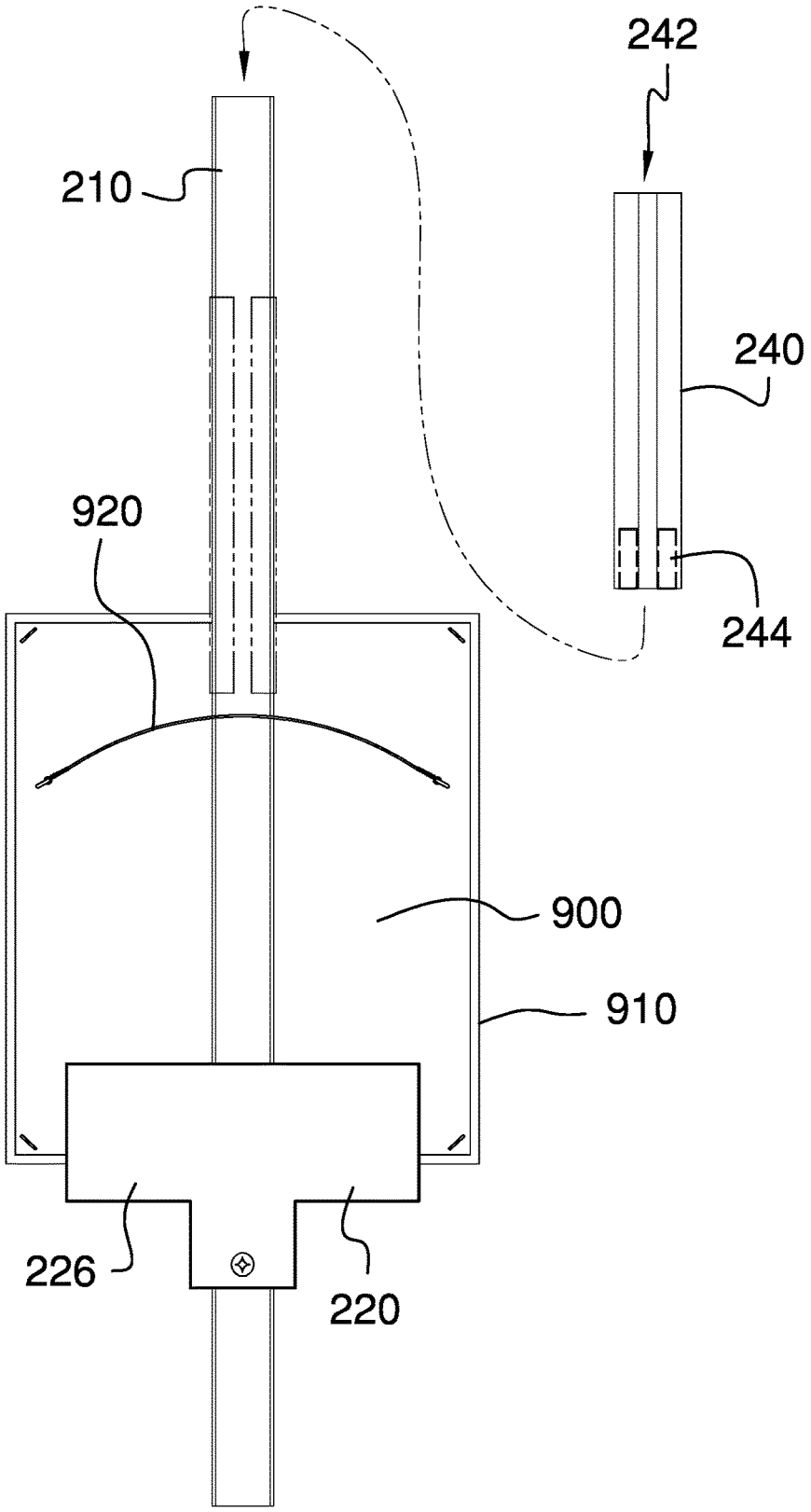
FIG. 4 is a rear view of an embodiment of the disclosure, illustrating the step of sliding the press bar over the top of the C channel.
Figure 5:
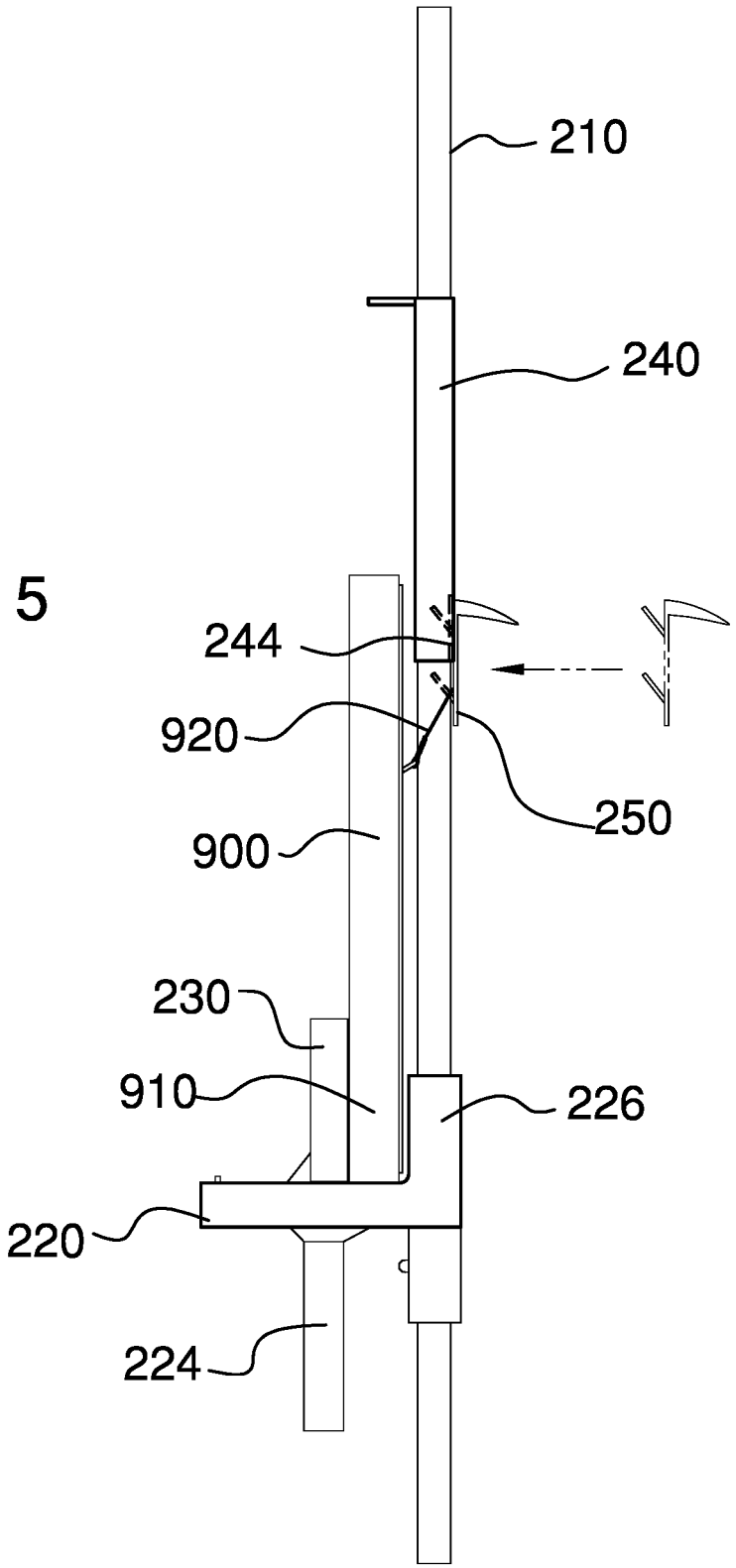
FIG. 5 is a right side view of an embodiment of the disclosure, illustrating the step of placing a hanger onto the press bar.
Figure 6A:
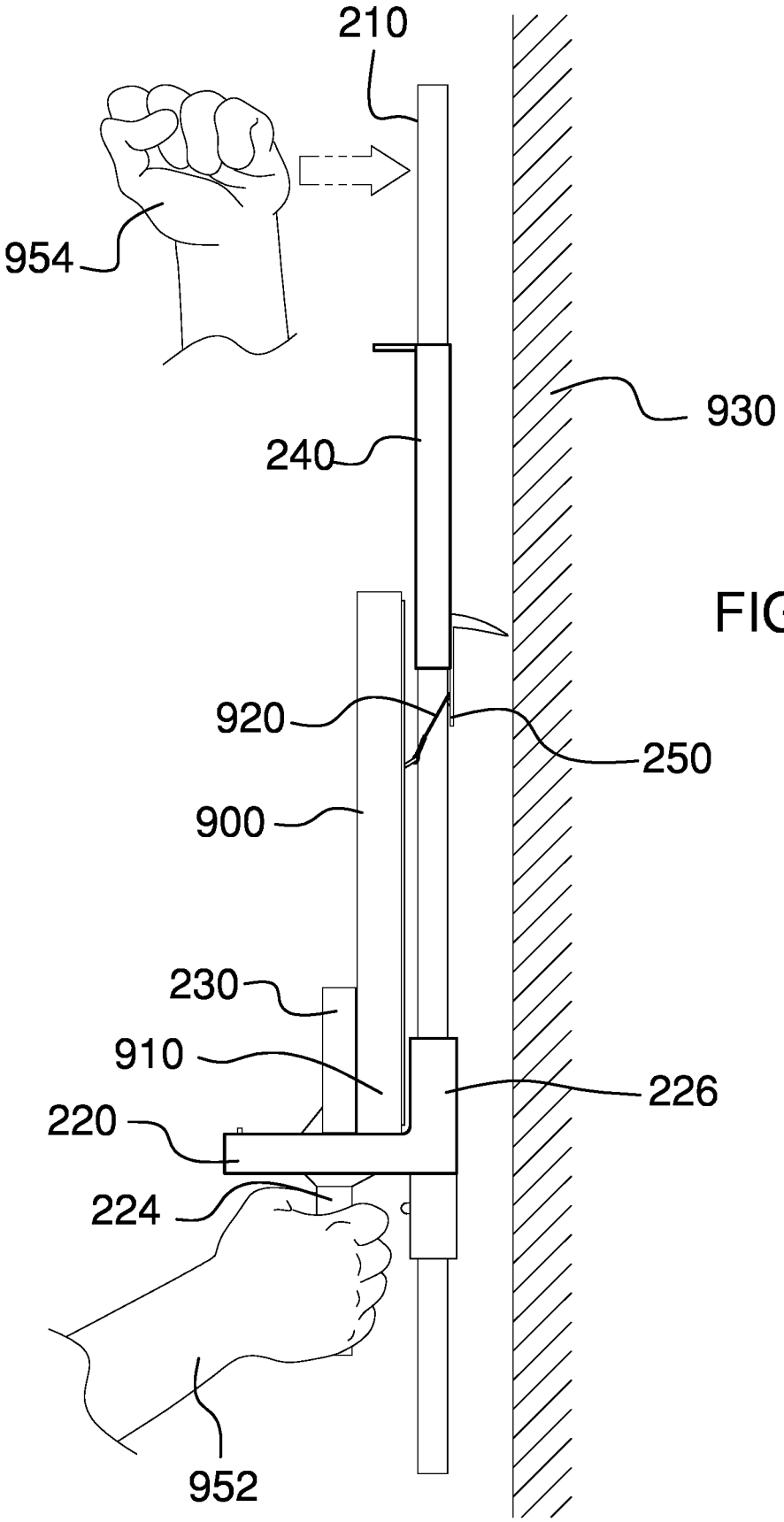
FIG. 6A is a right side view of an embodiment of the disclosure, illustrating the steps of placing the picture hanger with the picture against the display wall and pushing the top of the C channel against the display wall.
Figure 6B:
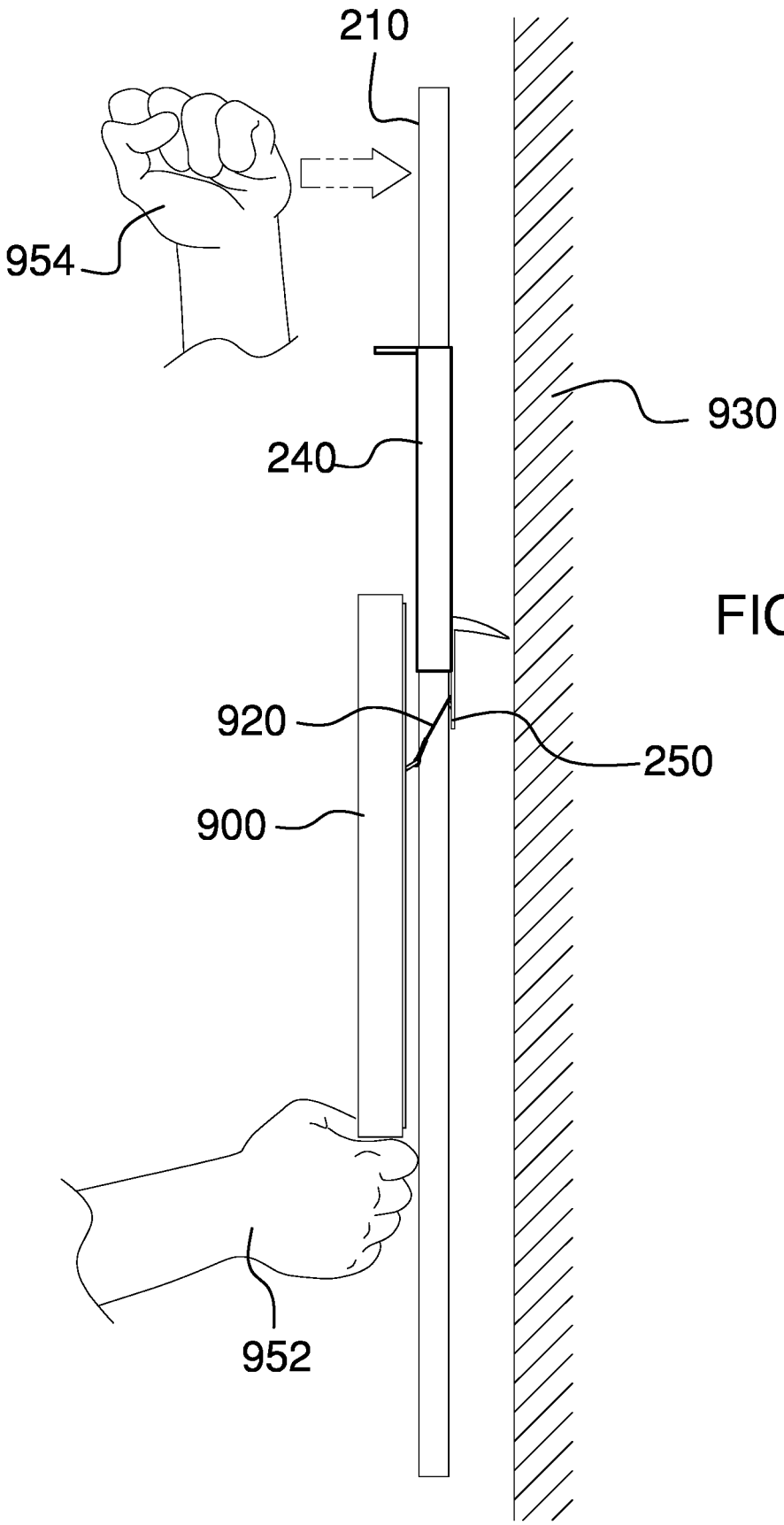
FIG. 6B is a right side view of an embodiment of the disclosure, illustrating the steps of placing the picture hanger with the picture against the display wall and pushing the top of the C channel against the display wall, but without the holder platform.
Figure 7:
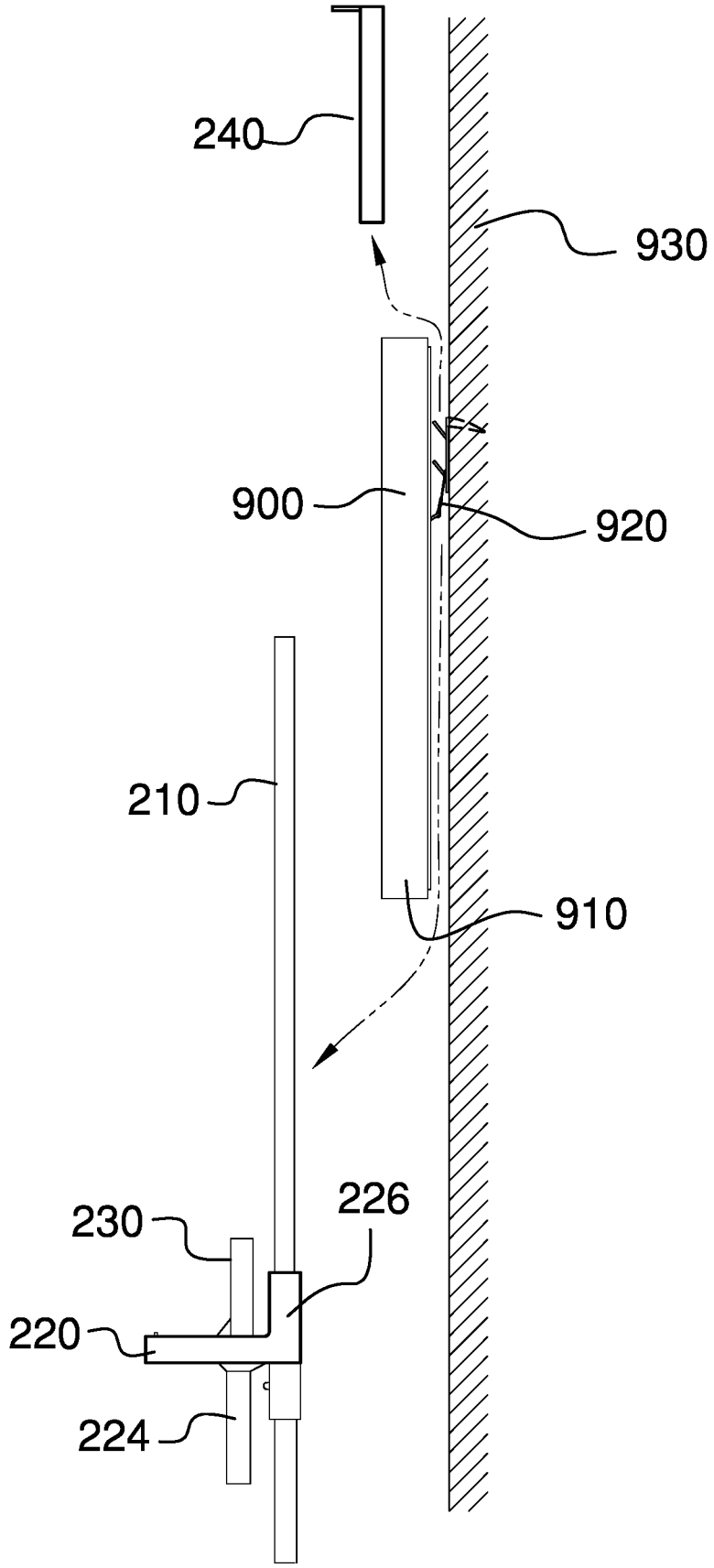
FIG. 7 is a right side view of an embodiment of the disclosure, illustrating the steps of separating the press bar from the C channel and sliding the holder platform and C Channel down below the picture.
Figure 8:
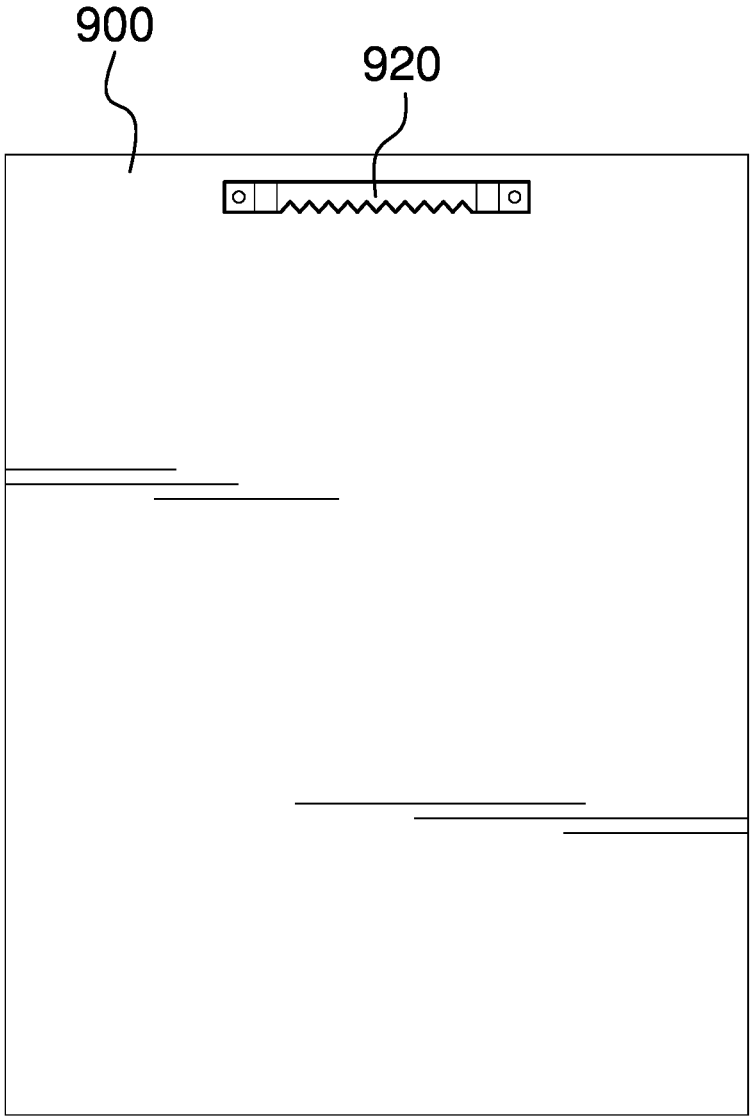
FIG. 8 is a view of a sawtooth bracket on a picture frame.

Detailed reference will now be made to a first potential embodiment of the disclosure, which is illustrated in FIGS. 1 through 8.

The present invention presents a picture hanging device 200 and a method of hanging a picture utilizing the picture hanging device 200. A picture 900 may be hung on a display wall 930 using the picture hanging device 200 to position and hold the picture 900. The picture 900 may be hung at a specific location on the display wall 930 by placing the picture 900 onto the picture hanging device 200, moving the picture 900 to the specific location using the picture hanging device 200, pressing on the picture hanging device 200 to impale a hanger 250 of the picture hanging device 200 into the display wall 930, and removing the picture hanging device 200—leaving the picture hanging on the hanger 250 at a specific location.

The picture hanging device 200 may comprise a C channel 210, a holder platform 220, a press bar 240, and the hanger 250. The C channel 210 may be a vertically-oriented armature that may be coupled to the holder platform 220. The C channel 210 may be further referred to as a vertical member. The C channel 210 may comprise an open rear face 212 to avoid mechanical interference with at least one hook 252 of the hanger 250. The picture 900 may rest upon the holder platform 220 with a hanging member 920 passing around the C channel 210 such that the C channel 210 passes between the picture 900 and the hanging member 920.

It shall be noted that the hanging member 920 is depicted as a picture cord in FIGS. 1-7. However, the hanging member may be a sawtooth bracket (see FIG. 8). It shall be further noted that a plurality of different types of devices may be used with the invention 100. The term hanging member 920 is to not be limited to one particular version over another.

The holder platform 220 may comprise a rear wall 226, a spring-loaded wall 230, and a handle 224. The picture 900 may rest upon the holder platform 220 between the rear wall 226 and the spring-loaded wall 230. The spring-loaded wall 230 may be slidably coupled to the holder platform 220 and may be pushed rearward towards the picture 900 by a spring 232. The handle 224 may be adapted to be grasped by a user in order to move the picture 900 to the specific location where the picture 900 is to be hung.

The press bar 240 may be a vertically-oriented hollow rectangular tube that may slide over the C channel 210. The press bar 240 may comprise a hook groove 242 that may run longitudinally up and down the rear side of the press bar 240. The press bar 240 may comprise one or more magnets 244 that May be located in any position of the press bar 240. The one or more magnets 244 may hold the hanger 250 in place on the rear of the press bar 240. It shall be noted that the one or more magnets may also be referred to as a securing member. Moreover, the one or more magnets 244 may be interchanged with an adhesive member or some other form of fastener.

The hanger 250 may be a vertically-oriented planar armature comprising at least one prong 254 projecting from the rear and the at least one hook 252 projecting from the front. The hanger may be made, at least in part, from a ferromagnetic material such that the hanger 250 is attracted to the one or more magnets 244. The at least one prong 254 may be configured to be impaled into the display wall 930 to fix the hanger 250 to the display wall 930. The hanger 250 may be configured to support the picture 900 via the hanging member 920.

In use (see FIG. 6A), the hanging member 920 may be placed over the top 214 and down behind the C channel 210 of the picture hanging device 200. The picture 900 may be placed onto the holder platform 220 with the bottom of the frame 910 resting on the holder platform 220 and the picture 900 pressed between the rear wall 226 of the holder platform 220 and the spring-loaded wall 230. It shall be further noted that the invention 100 may be used without the holder platform 220 (see FIG. 6B). The press bar 240 may be lowered onto the C channel 210. The hanger 250 may be placed on the rear of the press bar 240 with the at least one prong 254 pointing at the display wall 930. The at least one hook 252 may be located beneath the hanging member 920 and may project into the hook groove 242. The hanger 250 may be held in place on the press bar 240 by the one or more magnets 244.

The press bar 240 may be elevated to stretch the hanging member 920 to the full extent of the hanging member 920. The user may grasp the handle 224 using the user's first hand 952 and may place the picture hanging device 200 against the display wall 930. The user may move the picture hanging device 200 up, down, left, and right until the picture 900 is at the specific location where it is desired that the picture 900 hang. The user may press the top of the picture hanging device 200 against the display wall 930 using the user's second hand 954, thus embedding the at least one prong 254 into the display wall 930. The press bar 240 may then be removed from the top 214 and the C channel 210 may slide out from behind the picture 900 from the bottom, leaving the picture 900 and the hanger 250 on the display wall 930 at the specific location.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used herein, the words "couple", "couples", "coupled" or "coupling", may refer to connecting, either directly or indirectly, and does not necessarily imply a mechanical connection.

As used herein, the word "desired" may refer to a specific value or action within a range of supported values or action. A "desired" value or action may indicate that a range of values or actions is enabled by the invention and that a user of the invention may select a specific value or action within the supported range of values or actions based upon their own personal preference. As a non-limiting example, for a fan that supports operational speed settings of low, medium, or high, a user may select a desired fan speed, meaning that the user may select low, medium, or high speed based upon their needs and preferences at the time of the selection.

As used in this disclosure, a "ferromagnetic material" may be a material that is attracted to a magnet.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used herein, "handle" may refer to an object or aperture by which a tool, object, or door is held or manipulated with the hand.

As used in this disclosure, a "hook" may be an object that is curved or bent at an angle such that items can be hung on or caught by the object or such that the object may be suspended from another object.

As used herein, the word "longitudinal" or "longitudinally" may refer to a lengthwise or longest direction or to a direction that is perpendicular to the lateral direction.

As used in this disclosure, a "magnet" may be an ore, alloy, or other material that has its component atoms arranged so that the material exhibits properties of magnetism such as attracting iron-containing objects or aligning itself in an external magnetic field.

As used herein, "rectangle" and "rectangular" may refer to a closed figure comprising four straight lines joined by four right angles. The opposing sides of a rectangle have equal length. A square is considered to be a special type of rectangle where all four sides are the same length. An object may still be considered to have a generally rectangular shape even if corners of the object are rounded off as long as two sets of opposing, straight-line, perpendicular sides are apparent.

As used in this disclosure, a "spring" may be a device that is used to store mechanical energy. This mechanical energy will often be stored by deforming an elastomeric material that is used to make the device, by the application of a torque to a rigid structure, or by a combination thereof. In some embodiments, the rigid structure to which torque is applied May be composed of metal or plastic.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A method of hanging a picture comprising the steps of:

sliding a hanging member over a top of a C channel of a picture hanging device such that the C channel passes between a picture and the hanging member;

placing a bottom of a frame of the picture onto a holder platform such that the picture rests on the holder platform between a rear wall and a spring-loaded wall with the spring-loaded wall pushing the frame back securely against the rear wall;

sliding a press bar down over the top of the C channel such that a lower portion of the press bar is positioned behind the picture;

placing a hanger onto the press bar from a rear of the picture such that at least one hook of the hanger rides in a hook groove of the press bar, at least one prong of the hanger projects towards a display wall, the at least one hook is under the hanging member, and the hanger is retained by a securing member of the press bar;

placing the picture hanging device with the picture against the display wall by grasping a handle of the picture hanging device with a user's first hand and selecting a location for the picture by moving the picture hanging device up, down, left, and right until the picture is at a specific location;

pushing the top of the C channel against the display wall using a user's second hand to press the at least one prong into the display wall such that the hanger is supported by the display wall;

separating the press bar and the C channel by sliding the press bar up off of the top of the C channel such that the securing member of the press bar separate from the hanger and the press bar is removed from the C channel;

sliding the holder platform and the C channel down below the picture such that the holder platform and the C channel are separated from the picture with the picture left hanging on the display wall by the hanger.

2. The method of hanging a picture according to claim 1 wherein the C channel is coupled to the holder platform.

3. The method of hanging a picture according to claim 1 wherein the spring-loaded wall is slidably coupled to the holder platform.

4. The method of hanging a picture according to claim 3 wherein the spring-loaded wall is pushed towards the rear by a spring.

5. The method of hanging a picture according to claim 1 wherein the holder platform is configured to support the picture with the picture retained between the rear wall of the holder platform and the spring-loaded wall.

6. The method of hanging a picture according to claim 1 wherein the press bar slidably couples to the C channel.

7. The method of hanging a picture according to claim 1 wherein the press bar comprises the hook groove to provide clearance for the at least one hook of the hanger.

8. The method of hanging a picture according to claim 1 wherein the hanger comprises the at least one hook projecting from the front of the hanger and the at least one prong projecting from the rear of the hanger.

9. The method of hanging a picture according to claim 1 wherein the at least one hook is configured to support the hanging member.

10. The method of hanging a picture according to claim 1 wherein the at least one prong is configured to support the hanger on the display wall.

11. The method of hanging a picture according to claim 1 wherein the hanger comprises a ferromagnetic material.

12. The method of hanging a picture according to claim 1 wherein the press bar comprises the securing member operable to retain the hanger onto the press bar.

13. The method of hanging a picture according to claim 1 wherein the holder platform comprises the handle; wherein the handle is adapted for a user to grasp.

14. A method of hanging a picture comprising the steps of:

sliding a hanging member over a top of a vertical member of a picture hanging device such that the vertical member passes between a picture and the hanging member;

sliding a press bar down over the top of the vertical member such that a lower portion of the press bar is positioned behind the picture;

placing a hanger onto the press bar from a rear of the picture such that at least one prong of the hanger projects towards a display wall; placing the picture hanging device with the picture against the display wall by adaptively grasping a handle of the picture hanging device with a user's first hand and selecting a location for the picture;

pushing a top of the vertical member against the display wall by adaptively using a user's secondhand to press the at least one prong into the display wall;

separating the press bar and the vertical member by sliding the press bar up off of the top of the vertical member.

15. The method of hanging a picture according to claim 14 wherein placing the bottom of a frame of the picture onto a holder platform;

sliding the holder platform and the vertical member down below the picture such that the picture remains on the display wall by the hanger;

wherein the vertical member is coupled to the holder platform.

16. The method of hanging a picture according to claim 14 wherein the spring-loaded wall is slidably coupled to the holder platform;

wherein the spring-loaded wall is pushed towards the rear by a spring.

17. The method of hanging a picture according to claim 14 wherein the holder platform is configured to support the picture with the picture retained between a rear wall of the holder platform and a spring-loaded wall.

18. The method of hanging a picture according to claim 14 wherein the press bar slidably couples to the vertical member;

wherein the press bar comprises the hook groove to provide clearance for the at least one hook of the hanger.

19. The method of hanging a picture according to claim 14 wherein the hanger comprises the at least one hook projecting from the front of the hanger and the at least one prong projecting from the rear of the hanger.

20. The method of hanging a picture according to claim 14 wherein the at least one hook is configured to support the hanging member;

wherein the at least one prong is configured to support the hanger on the display wall.

* * * * *